US007142799B2

(12) United States Patent
Kitayama

(10) Patent No.: US 7,142,799 B2
(45) Date of Patent: Nov. 28, 2006

(54) IMAGE FORMING APPARATUS PERFORMING PRIMARY IMAGE TRANSFER FROM AN IMAGE FORMING MEANS TO AN INTERMEDIATE TRANSFER BELT AND SECONDARY IMAGE TRANSFER FROM THE BELT TO A RECORDING MATERIAL

(75) Inventor: Kunihiko Kitayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/195,636

(22) Filed: Aug. 3, 2005

(65) Prior Publication Data

US 2006/0029438 A1 Feb. 9, 2006

(30) Foreign Application Priority Data

Aug. 6, 2004 (JP) ..... 2004-231408

(51) Int. Cl.
*G03G 15/16* (2006.01)

(52) U.S. Cl. ..... 399/297; 399/302; 399/165

(58) Field of Classification Search ..... 399/297, 399/298, 165, 302
See application file for complete search history.

(56) References Cited

U.S. PATENT DOCUMENTS

| | | | | |
|---|---|---|---|---|
| 6,321,052 | B1 * | 11/2001 | Yamashina et al. | 399/165 |
| 6,505,024 | B1 * | 1/2003 | Kayahara et al. | 399/302 |
| 6,522,850 | B1 * | 2/2003 | Hiroki | 399/164 |
| 2002/0044799 | A1 * | 4/2002 | Sasamoto et al. | 399/298 |
| 2005/0078988 | A1 * | 4/2005 | Matsui et al. | 399/302 |
| 2005/0276620 | A1 | 12/2005 | Omata | 399/49 |

FOREIGN PATENT DOCUMENTS

| | | |
|---|---|---|
| JP | 2001-215770 | 8/2001 |
| JP | 2002-278204 | 9/2002 |

* cited by examiner

*Primary Examiner*—David M. Gray
*Assistant Examiner*—Bryan Ready
(74) *Attorney, Agent, or Firm*—Fitzpatrick, Cella, Harper & Scinto

(57) ABSTRACT

The present invention relates to an image forming apparatus comprising: an image bearing member; toner image forming means for forming a plurality of toner images on the image bearing member; primary transfer means for superimposing the plurality of toner images on the image bearing member on one another in succession to primary transfer the same to a moving intermediate transfer belt in a primary transfer region; a driving source for moving the intermediate transfer belt through a driving transmitting member with respect to a driving roller which supports the intermediate transfer belt and which moves the intermediate transfer belt; a secondary transfer means for collectively secondary transferring the toner images on the intermediate transfer belt to a recording material; removing means which can abut against and separate from the intermediate transfer belt in a approaching and separating region on the intermediate transfer member and which removes toner on the intermediate transfer belt; and locus varying means which shortens a length of a moving locus from the approaching and separating region of the intermediate transfer belt to the primary transfer region while the removing means is in abutment against the intermediate transfer belt, as compared with a moving locus from the approaching and separating region of the intermediate transfer belt to the primary transfer region while the removing means is separated from the intermediate transfer belt.

4 Claims, 9 Drawing Sheets

IMAGE FORMING APPARATUS PERFORMING PRIMARY IMAGE TRANSFER FROM AN IMAGE FORMING MEANS TO AN INTERMEDIATE TRANSFER BELT AND SECONDARY IMAGE TRANSFER FROM THE BELT TO A RECORDING MATERIAL

BACKGROUND OF THE INVENTION

1. Field of the Invention

The present invention relates to an electrophotographic type image forming apparatus and an electrostatic recording type image forming apparatus such as copying machines and printers, and more particularly, to an image forming apparatus having one photosensitive member drum and an intermediate transfer belt.

2. Description of the Related Art

Conventionally, a single-drum intermediate transfer belt type color image forming apparatus (apparatus for forming a color image using one photosensitive member drum and an intermediate transfer belt) has a problem that color deviation is generated due to variation in load such as approaching and separating motions of a transfer cleaner and a secondary transfer roller.

A mechanism of generation of the color deviation will be explained. FIG. 7(*a*) is a diagram used for explaining an essential portion of a conventional image forming apparatus. The image forming apparatus shown in FIG. 7(*a*) is a single-drum intermediate transfer belt type color image forming apparatus. In this structure, toner images of various colors formed on a photosensitive member drum 101 are transferred to an intermediate transfer belt 102 by a primary transfer unit 102*a* in succession and with this operation, the toner images are superposed and transferred on a surface of the intermediate transfer belt 102, thereby forming a color toner image. A recording material P is conveyed in synchronization with the toner images on the intermediate transfer belt 102, and toner images are collectively transferred on the recording material P by a secondary transfer unit 102*b*.

A secondary transfer roller 103 which is secondary transfer means can approach and separate from the intermediate transfer belt 102. While a primary transfer step is carried out by the intermediate transfer belt 102, the secondary transfer roller 103 is separated from the intermediate transfer belt 102, and when a secondary transfer step is carried out, the secondary transfer roller 103 abuts against the intermediate transfer belt 102.

A transfer cleaner 104 cleans a surface of the intermediate transfer belt 102. The transfer cleaner 104 can also approach and separate from the intermediate transfer belt 102. The intermediate transfer belt 102 is supported by a plurality of rollers, and is driven through a driving roller 105. The transfer cleaner 104 is located at a position opposed to the driving roller 105, and is brought into contact with the intermediate transfer belt 102 under pressure by applying a force to the driving roller 105 through the intermediate transfer belt 102. The transfer cleaner 104 abuts against the intermediate transfer belt 102 after the secondary transfer, and is separated from the intermediate transfer belt 102 before a next primary transfer toner image reaches, and the transfer cleaner 104 removes residual toner (toner which was not transferred) remaining on the intermediate transfer belt 102 (residual toner which was not secondary transferred).

Generally, a blade cleaning is frequently employed for the transfer cleaner 104, and its frictional resistance is high.

Thus, if the transfer cleaner 104 approaches and separates from the intermediate transfer belt 102, load variation is generated in a driving roller shaft. A shaft and a gear which are constituent elements of a driving system, a supporting casing of a driving unit are elastic members and thus, elastic deformation is generated by the driving load. Therefore, if the load variation is generated in the driving roller 105 when the transfer cleaner 104 approaches and separates, the elastic deformation amount of the driving system is varied, and the driving roller 105 is displaced in the circumferential direction of the intermediate transfer belt 102.

In recent years, it is required to reduce the apparatus in size and thus, the length of the intermediate transfer belt 102 in the circumferential direction is short, and also when the transfer cleaner 104 approaches and separates, the primary transfer is carried out. For example, if the transfer cleaner 104 is shifted from its separated state to its abutment state during the primary transfer of the fourth color, the driving roller 105 is displaced by a distance δ in a delay direction as shown in the drawings. With this, a YMC image which has already been carried by a transfer belt is deviated in the delay direction by the distance δ with respect to a K image which is the fourth color carried by the photosensitive member drum 101.

FIG. 7(*b*) shows the actual image recorded in the recording material. FIG. 7(*b*) shows that in an image formed on a peripheral surface of the photosensitive member drum 101 with the same pitch, the K image which is the fourth color generates color deviation with respect to other colors on the intermediate transfer belt 102 and on the recording material P. FIG. 7(*c*) is a graph of the color deviation amount of this image. In FIG. 7(*c*), the horizontal axis shows a sub-scanning direction position (transfer position direction of the recording material), and the vertical axis shows color deviation amounts of the colors based on cyan which is the third color as a reference. It can be found that yellow (Y) that is a first color and magenta (M) that is a second color do not generate color deviation with respect to cyan (C), but black (K) that is a fourth color generates the color deviation in a shrinking direction at a rear end in the image. The color deviation amount is equal to a displacement amount δ on a peripheral surface of the driving roller 105. As one example of an actual numerical value, when a load variation value is 14.7 Ncm for example, color deviation of about 100 μm is generated.

To solve this problem, it is proposed that a direction of an external force (external force acting on the intermediate transfer unit) generated when the transfer cleaner approaches and separates is set to a direction substantially opposite from the rotating/moving direction of the intermediate transfer belt in the primary transfer position, the deviation of the belt in the circumferential direction and the deviation of the unit displacement are offset, and the color deviation is reduced (see Patent Document 1).

[Patent Document 1]

Japanese Patent Application Laid-open No.2002-278204 (paragraph 0081, FIG. 13)

SUMMARY OF THE INVENTION

However, the structure according to Patent Document 1 has the following problem.

When a transfer cleaner or the like is biased and brought into contact with the intermediate transfer belt under pressure, a difference in response is generated between the deviation of the belt in the circumferential direction by the pressure contact (displacement of the driving roller in the circumferential direction) and the displacement of the entire unit by the biasing force. For this reason, time axis waveforms of both of them do not coincide (not symmetric), and the color deviation is not overcome completely. Especially when one of the deviation of the belt in the circumferential direction and the unit displacement has faster response, there is an adverse possibility that abrupt speed variation is transmitted from the belt to the photosensitive member drum and a failure image is generated due to variation in light exposure.

If large vibration is generated due to displacement of the intermediate transfer unit, the vibration is propagated to the optical system or the photosensitive member drum, and variation in light exposure (banding) is adversely generated. Thus, there is a fear that the entire unit is positively displaced.

Since the displacement of the transfer unit can be limited in only one direction, there is a problem that load variations of both the transfer cleaner and the secondary transfer roller can not be settled.

It is an object of the present invention to prevent generation of color deviation caused by load variation such as approaching and generation of separating motions of a transfer cleaner and a failure image caused by variation in light exposure.

To solve the above problem, the present invention provides an image forming apparatus comprising: an image bearing member; toner image forming means for forming a plurality of toner images on the image bearing member; primary transfer means for superimposing the plurality of toner images on the image bearing member on one another in succession to primary transfer the same to a moving intermediate transfer belt in a primary transfer region; a driving source for moving the intermediate transfer belt through a driving transmitting member with respect to a driving roller which supports the intermediate transfer belt and which moves the intermediate transfer belt; a secondary transfer means for collectively secondary transferring the toner images on the intermediate transfer belt to a recording material; removing means which can abut against and separate from the intermediate transfer belt in a approaching and separating region on the intermediate transfer member and which removes toner on the intermediate transfer belt; and locus varying means which shortens a length of a moving locus from the approaching and separating region of the intermediate transfer belt to the primary transfer region while the removing means is in abutment against the intermediate transfer belt, as compared with a moving locus from the approaching and separating region of the intermediate transfer belt to the primary transfer region while the removing means is separated from the intermediate transfer belt.

According to the present invention, it is possible to reduce the color deviation caused by load variation such as approaching and separating motions of the transfer cleaner by changing the distance on the intermediate transfer belt from the driving means to the primary transfer unit by the distance changing means.

DESCRIPTION OF THE PREFERRED EMBODIMENT

Figure 6:
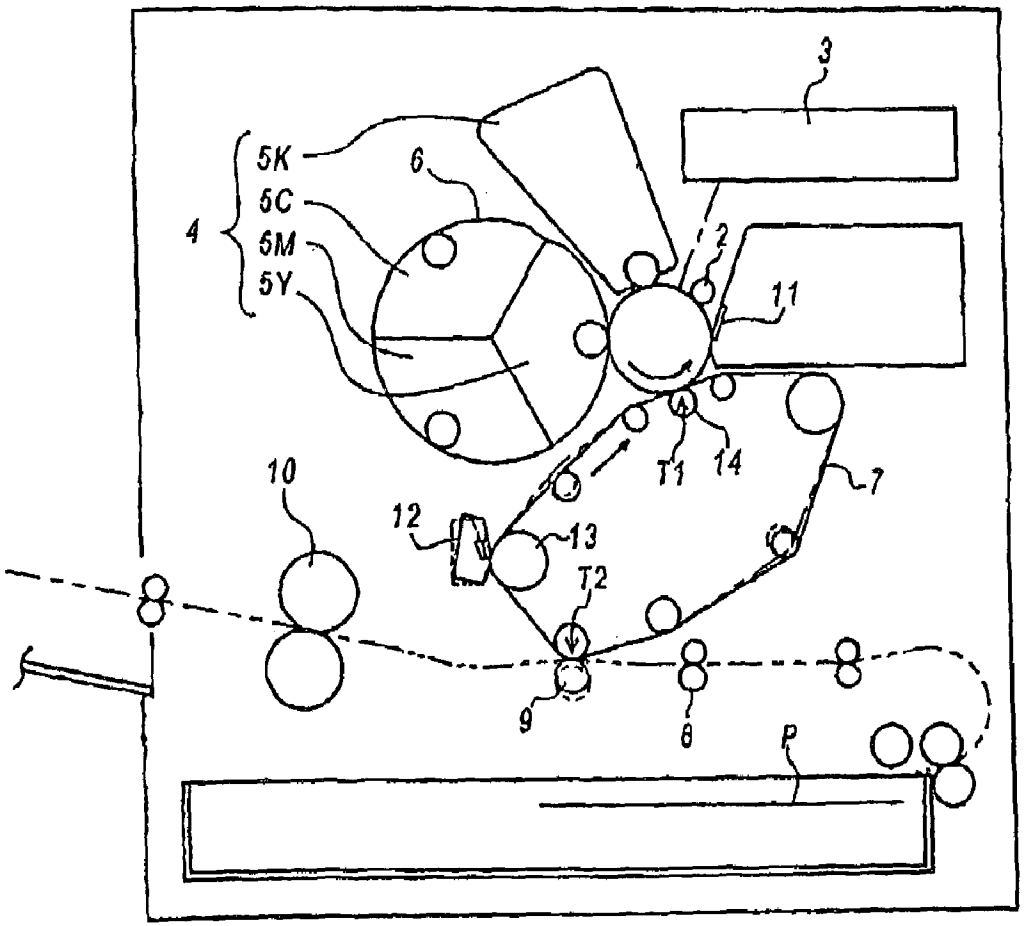
FIG. 6 is a sectional view of a single-drum intermediate transfer belt type color image forming apparatus.

An embodiment of an image forming apparatus of the present invention will be explained. First, the entire structure of the image forming apparatus will be explained. FIG. 6 is a sectional view of a single-drum intermediate transfer belt type color image forming apparatus.

In FIG. 6, a photosensitive member drum 1 that is a image bearing member is rotatably provided. A charging roller 2 is disposed above the photosensitive member drum 1. The charging roller 2 uniformly charges a surface of the photosensitive member drum 1. A laser unit 3 that is writing means selectively exposes the surface of the photosensitive member drum 1 to light in accordance with an image signal, thereby forming an electrostatic latent image.

A development apparatus 4 located on the left side of the photosensitive member drum 1 clearly forms the electrostatic latent image by toner. The development apparatus 4 includes four development units 5Y, 5M and 5C having toner of various colors including yellow (Y), magenta (M), cyan (C) and black (K). The color development units 5Y, 5M and 5C mounted on a rotation development apparatus 6 are opposed to the photosensitive member drum 1 in succession and carry out developing steps. Then, the black development unit 5K which is always opposed to the photosensitive member drum 1 is operated to carry out the developing step.

An intermediate transfer belt 7 that is an intermediate transfer member is disposed below the photosensitive member drum 1. The toner images which were clearly formed by the development units are primary transferred in succession in superimposed manner by a primary transfer unit T1 which is opposed to the photosensitive member drum 1 and the primary transfer roller 14, and a color toner image is obtained on a surface of the intermediate transfer belt 7.

A recording material P is fed to a registration roller pair 8 by a feeding unit. The recording material P which was on standby at the registration roller pair 8 is sent to a secondary transfer unit T2 in synchronization with the toner image on the intermediate transfer belt 7. A secondary transfer roller 9 that is secondary transfer means can approach and separate from the intermediate transfer belt 7. The secondary transfer roller 9 is separated from the intermediate transfer belt 7 while the primary transfer step is carried out by the intermediate transfer belt 7, and the secondary transfer roller 9 abuts against the intermediate transfer belt 7 when the secondary transfer step is carried out. A toner image is transferred onto the recording material P by the secondary transfer unit T2. The toner image carried on the recording material P is fixed to the recording material P by heat and pressure of the fixing roller 10, and the image forming operation with respect to the recording material P is completed.

The photosensitive member drum 1 is provided with a drum cleaner 11, and the intermediate transfer belt 7 is provided with a transfer cleaner 12 that is an example of load applying means. Both of them are of blade cleaning type. The drum cleaner 11 removes residual toner remaining on the photosensitive member drum 1 by the primary transfer step. The transfer cleaner 12 can approach and separate from the intermediate transfer belt 7, and removes residual toner remaining on the intermediate transfer belt 7.

Figure 1:
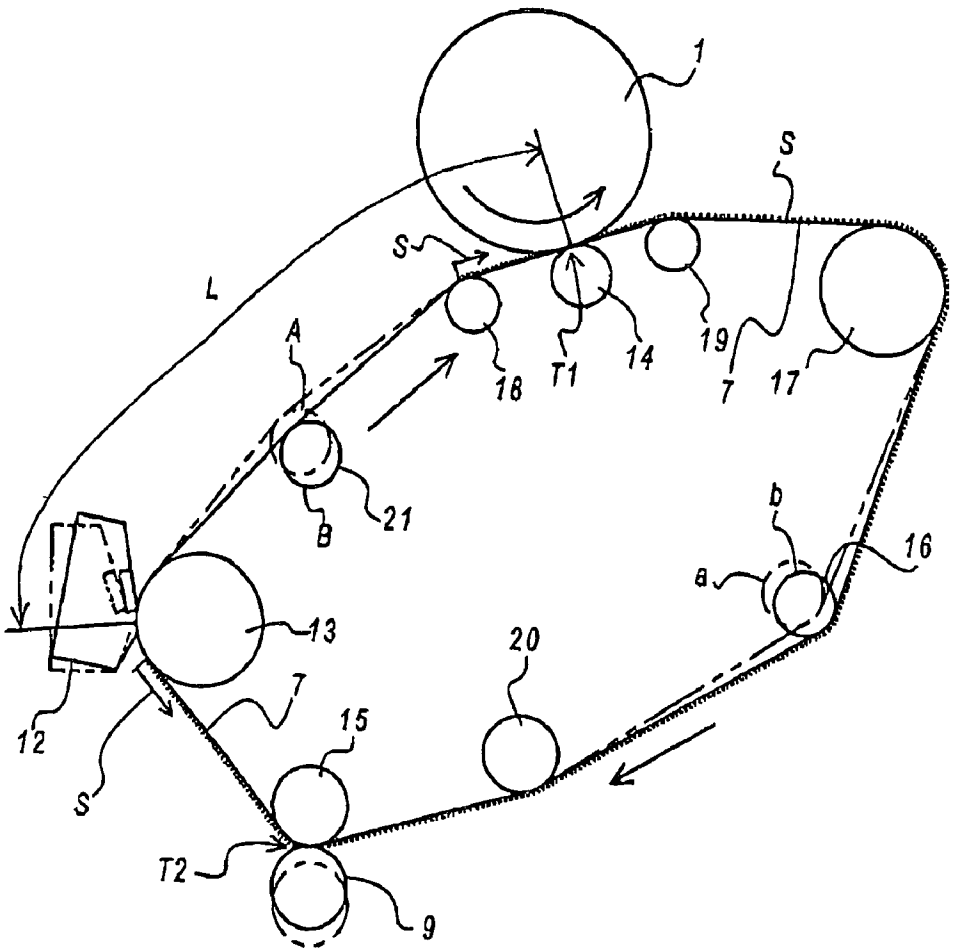
FIG. 1 shows a cross section of an intermediate transfer unit.
Figure 2:
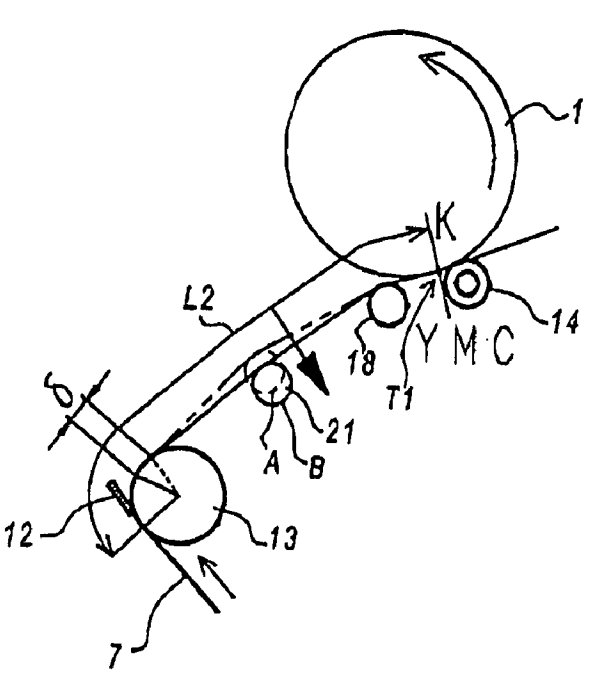
FIG. 2 are diagrams used for explaining operations of the transfer roller and the moving roller.
Figure 2:
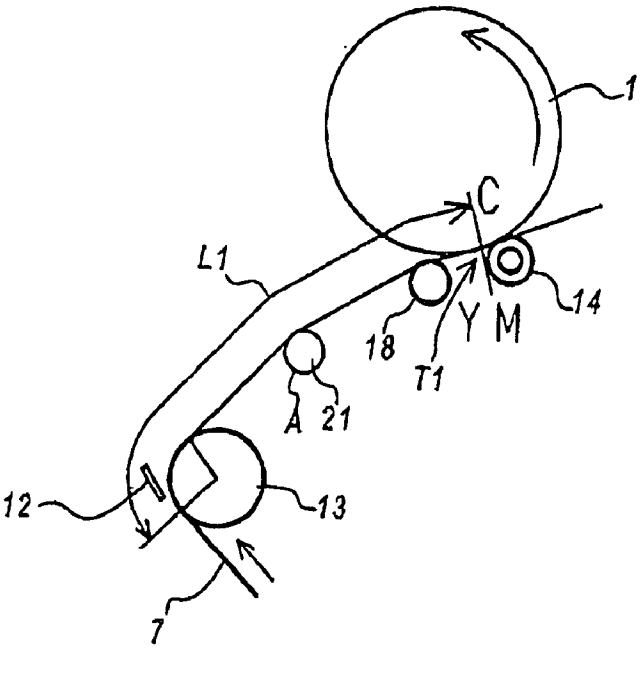
Figure 3:
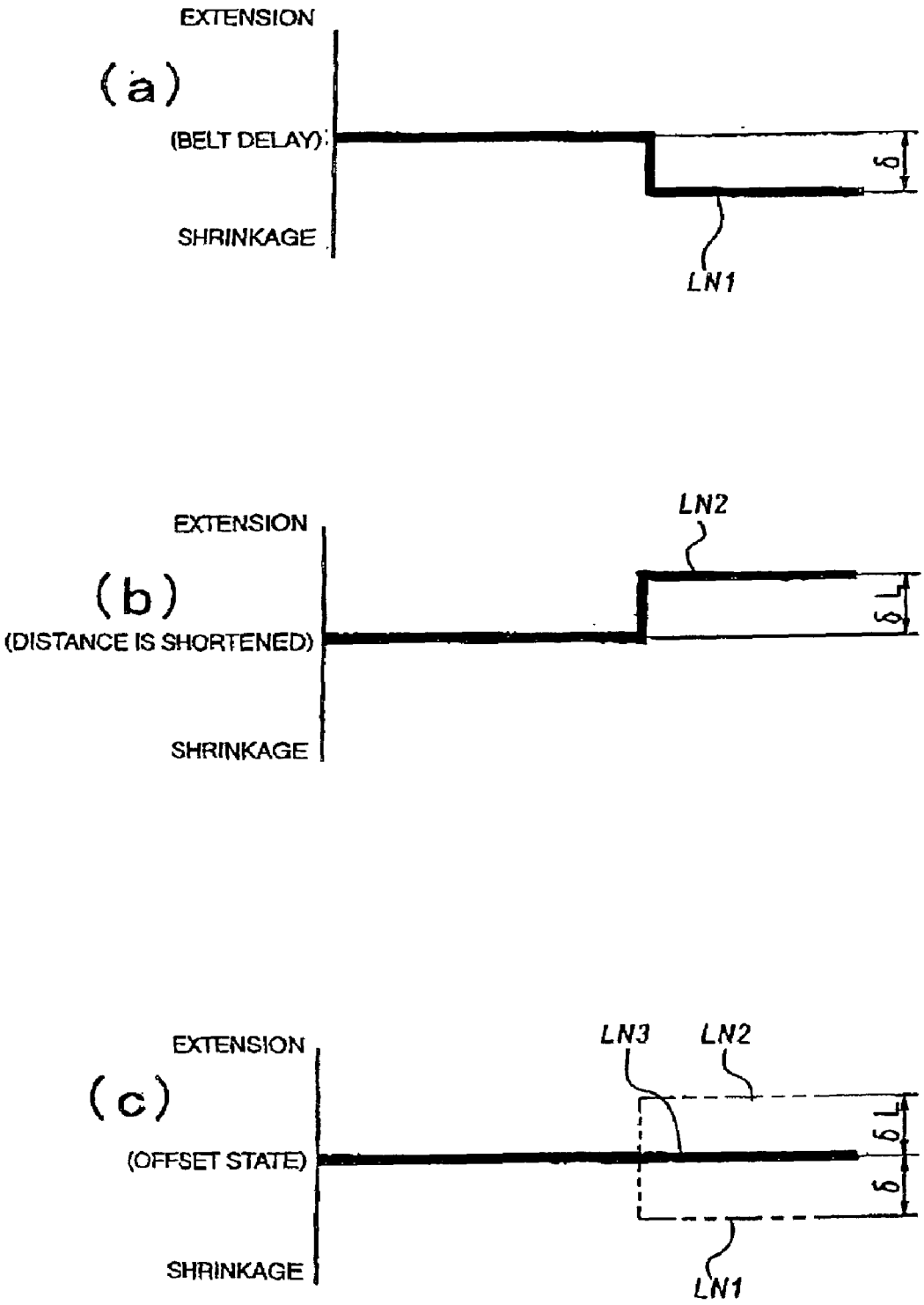
FIG. 3 are diagrams showing color deviation in a sub-scanning direction of an image.
Figure 4:
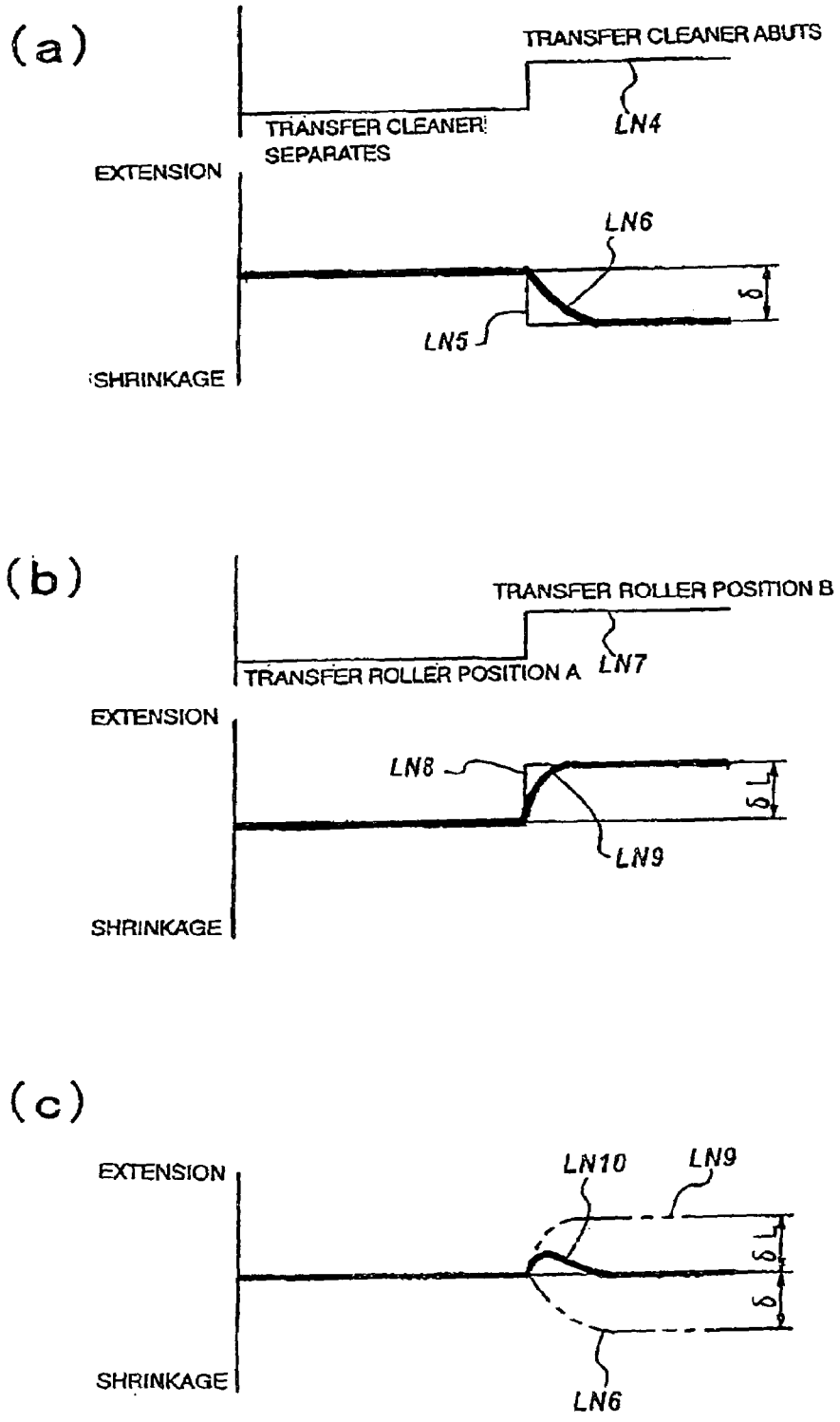
FIG. 4 are diagrams showing time axis waveforms of the color deviation.
Figure 5:
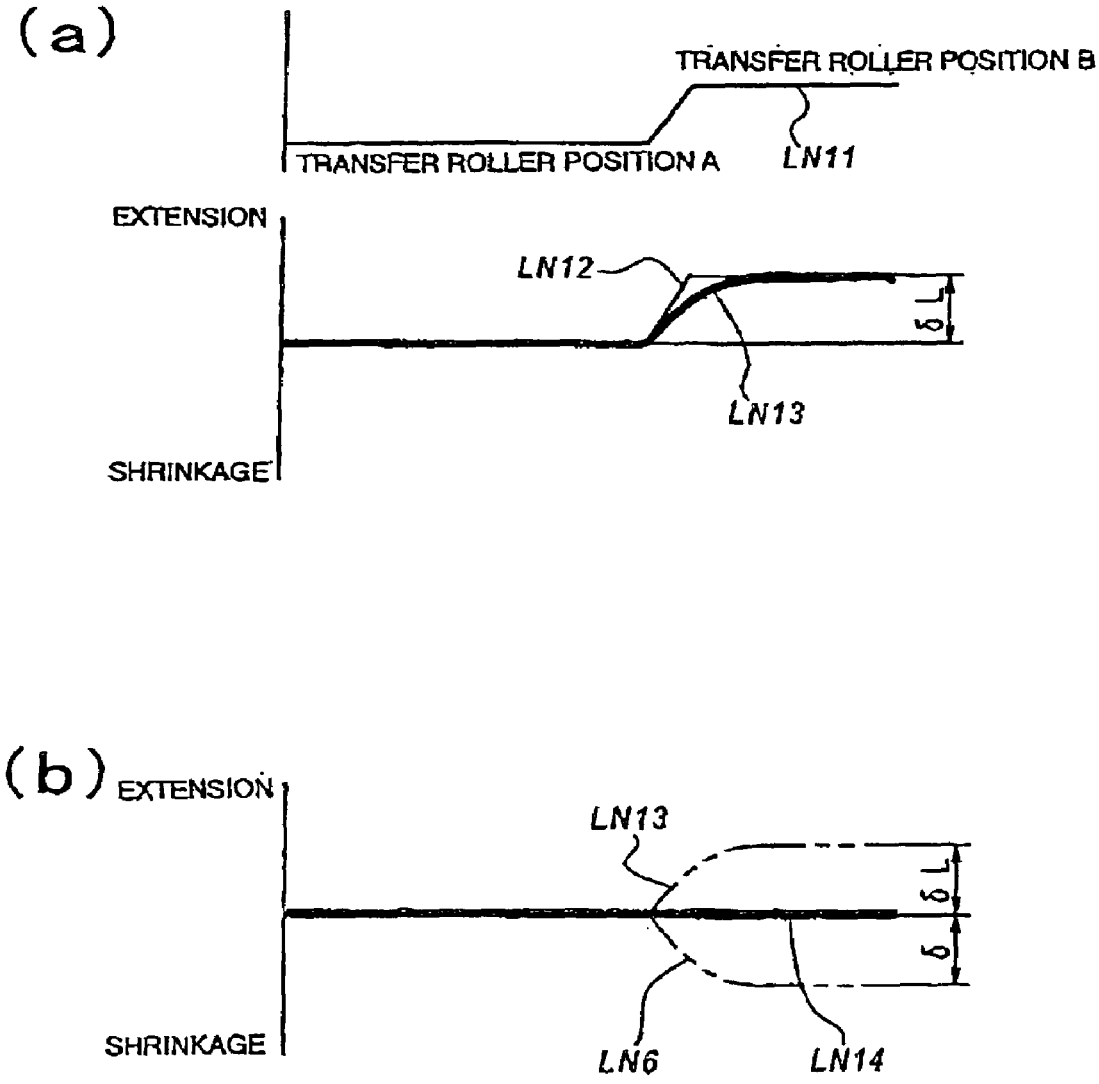
FIG. 5 are diagrams showing time axis waveforms of the color deviation when a drive profile of the moving roller is changed.

A structure around the intermediate transfer unit and function thereof which are features of the present invention will be explained. FIG. 1 is a sectional view of the intermediate transfer unit, FIG. 2 is a diagram used for explaining operations of the transfer roller and a moving roller, FIG. 3 is a diagram showing a color deviation in a sub-scanning direction of image, FIG. 4 is a diagram showing a time axis waveform of the color deviation, and FIG. 5 is a diagram showing the time axis waveform of the color deviation when drive profile of the moving roller is changed.

Figure 8:
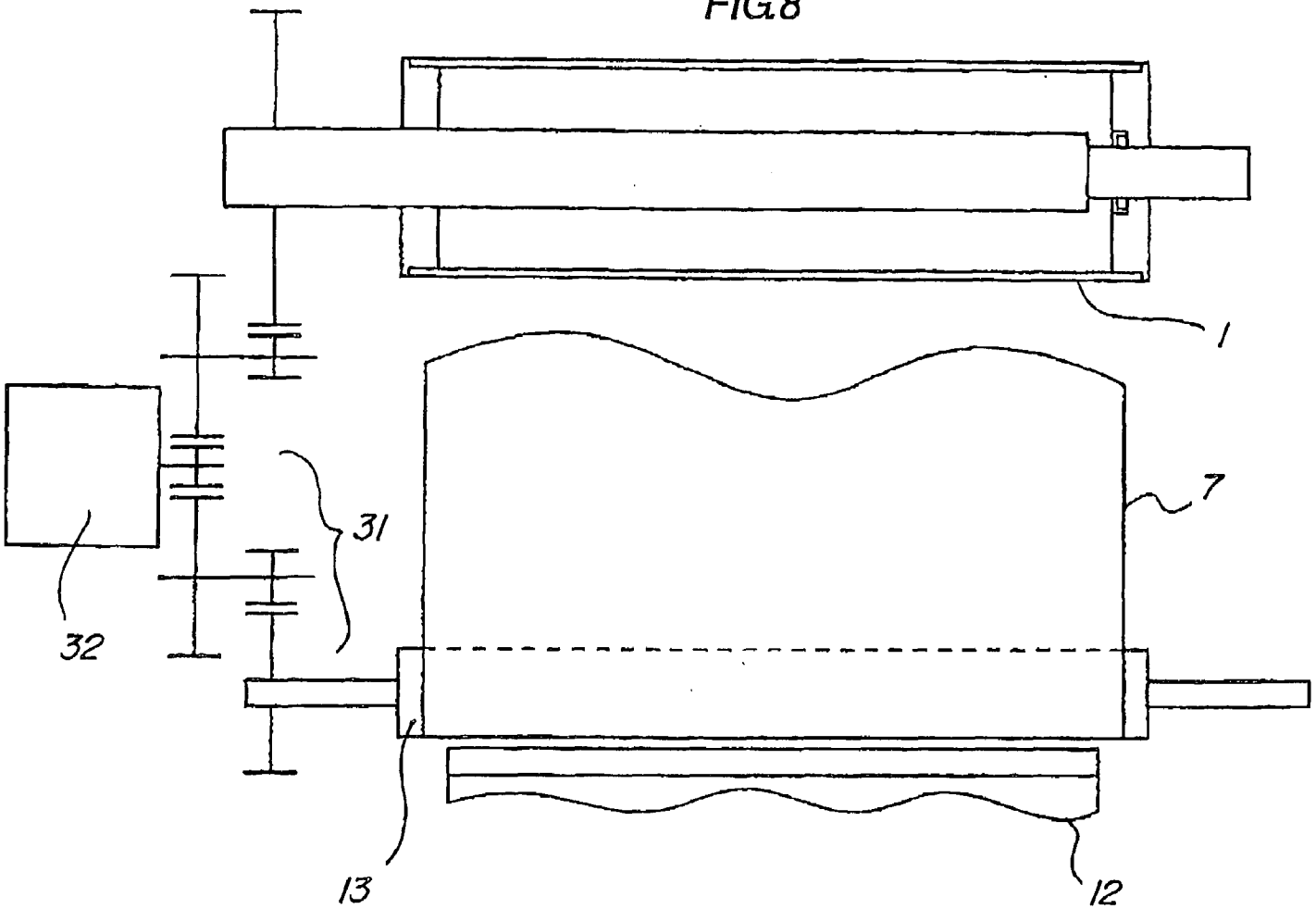
FIG. 8 is a plane view of inter mediate transfer belt of image forming apparatus.

As shown in FIG. 1, the intermediate transfer belt 7 is supported by a driving roller 13 that is one example of driving means and a plurality of rollers. As show in FIG. 8, The driving roller 13 rotates and drives the intermediate transfer belt 7, and is driven by a motor 32 as driving source through a speed reduction gear train 31. A primary transfer roller 14 carries out the primary transfer to the intermediate transfer belt 7 by the photosensitive member drum 1. A roller 15 in the secondary transfer carries out secondary transfer to the recording material P by the intermediate transfer belt 7 in cooperation with the secondary transfer roller 9. A tension roller 16 provides the belt with appropriate tension to prevent the driving roller 13 and the intermediate transfer belt 7 from slipping with respect each other, and allows the intermediate transfer belt 7 to stably run. The tension roller 16 can move, and is biased outward from inner side of the unit by a spring (not shown). The idler roller 17 controls deviation of the belt, and can adjust a base line with respect to the driving roller 13. Auxiliary rollers 18, 19 and 20 limit a cross sectional shape of the belt (nip shapes of the primary transfer unit and the secondary transfer unit) to stabilize the performance of the transfer step.

In FIG. 1, a toner image region S which is primary transferred on the intermediate transfer belt 7 is shown with broken line. The toner image is transferred on the recording material in the secondary transfer unit T2, but the toner image is also shown at downstream of the secondary transfer unit T2 in the drawing for the sake of convenience of explanation of range. The toner image region S shows the maximum size recording material (e.g., A4) that can be processed by the image forming apparatus. As explained in the column of background technique, since it is required to reduce the apparatus in size in recent years, the circumferential length of the intermediate transfer belt 7 is set as short as possible. It is necessary that the transfer cleaner 12 is brought into contact with the intermediate transfer belt 7 under pressure before the toner image region S after the secondary transfer reaches the cleaning position. Due to these reasons, when the transfer cleaner 12 abuts against the intermediate transfer belt 7, the primary transfer of K image that is the fourth color is not completed in some cases (this problem is not generated when a small image is to be formed).

Figure 9:
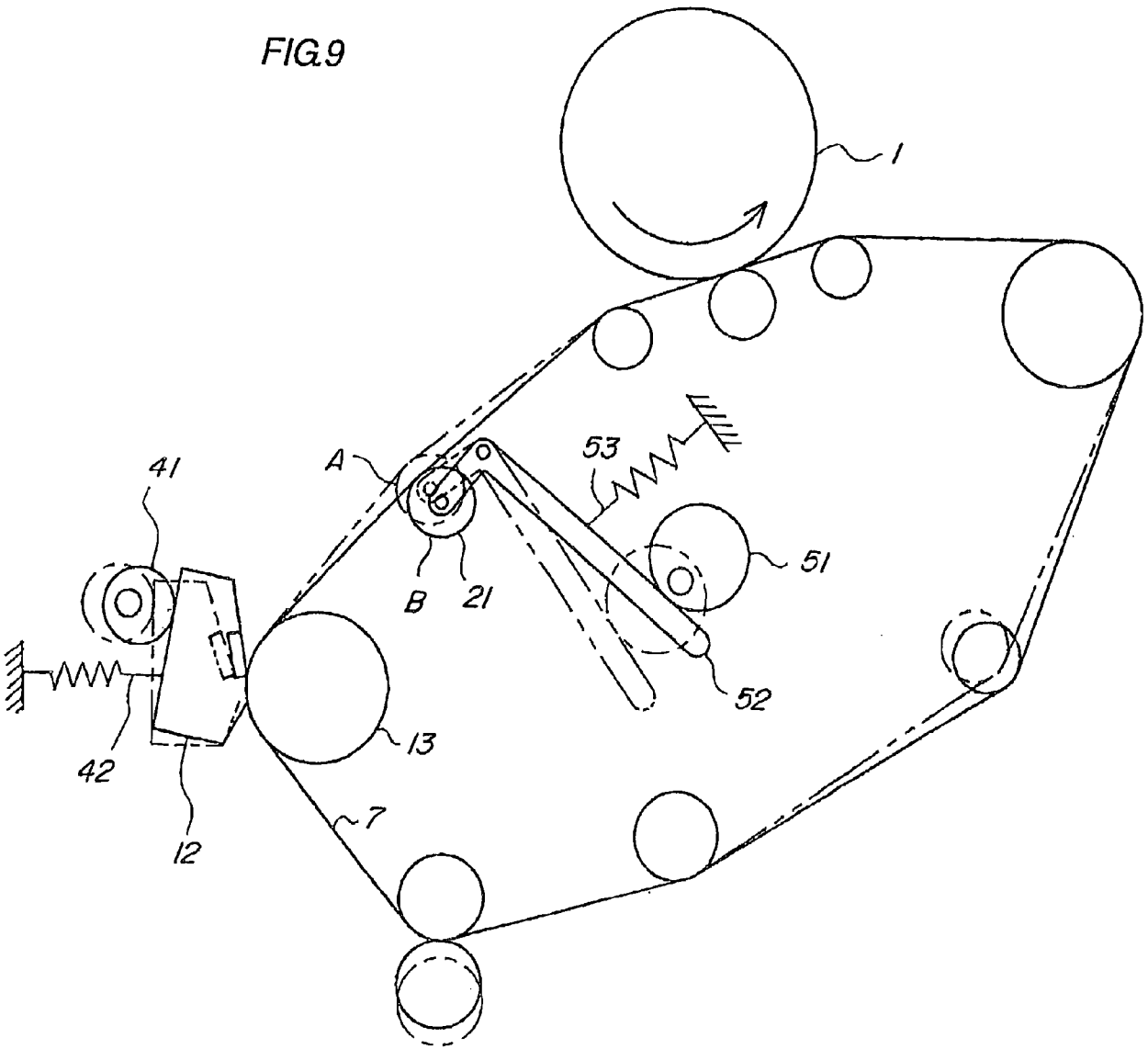
FIG. 9 is a side view showing intermediate transfer belt of image forming apparatus.

As explained in the column of background technique, as the transfer cleaner 12 approaches and separates, load variation is generated in the driving roller 13, and the driving roller 13 is displaced in the circumferential direction. As shown in FIG. 9, the transfer cleaner 12 can contact or separate with the intermediate transfer belt 7 by a cleaner contacting-separating means constructed with cam 41 and a spring 42. If the transfer cleaner 12 is shifted from its separated state to its abutment state during the primary transfer of fourth color, the driving roller 13 is displaced in the delay direction by the distance δ, and the YMC images which have already been carried on the transfer belt 7 is displaced in the delay direction by the distance δ with respect to the K image which is the fourth color carried on the photosensitive member drum 1 at the primary transfer unit.

In this embodiment, a moving roller 21 as an example of distance changing means is provided. The moving roller 21 changes a distance L (length of path) on the intermediate transfer belt 7 between the primary transfer unit T1 and the driving roller 13 that is the driving means. The moving roller 21 is driven by moving means, and can displace between an outward position (position A in the drawing) and an inward position (position B in the drawing) with respect to the intermediate transfer belt 7. As shown in FIG. 9, the moving roller 21 is movable between position A and position B by the moving means constructed with a cam 51, an arm 52 and a spring 53.

FIGS. 2(*a*) and 2(*b*) show states in which the transfer cleaner 12 is separated from and abutted against the intermediate transfer belt 7, respectively. If the moving roller 21 moves, the cross sectional shape of the belt is changed, and the distance L on the intermediate transfer belt 7 between the driving roller 13 and the primary transfer unit T1 is changed. A distance L2 when the moving roller 21 is located on the inward position (position B in the drawing) is shorter than a distance L1 when the moving roller 21 is located on the outward position (position A in the drawing). At that time, the tension roller 16 which is biased by the spring is displaced to the position b from the position a shown in FIG. 1 in association with the operation of the moving roller 21. With this, the entire path length and tension of the intermediate transfer belt 7 are maintained at constant level.

As shown in FIG. 2(*a*), when the transfer cleaner 12 is separated from the intermediate transfer belt 7, the moving roller 21 is located on the outward position (position A in the drawing). Then, as shown in FIG. 2(*b*), if the transfer cleaner 12 abuts against the intermediate transfer belt 7, the moving roller 21 is moved to the inward position (position B in the drawing) in synchronization therewith. The difference δL (not shown) between the distance L1 when the moving roller 21 is located on the outward position and the position L2 when the moving roller 21 is located on the inward position with respect to the distance δ caused when the transfer cleaner 12 abuts is set as explained below, thereby preventing the color deviation.

Figure 7:
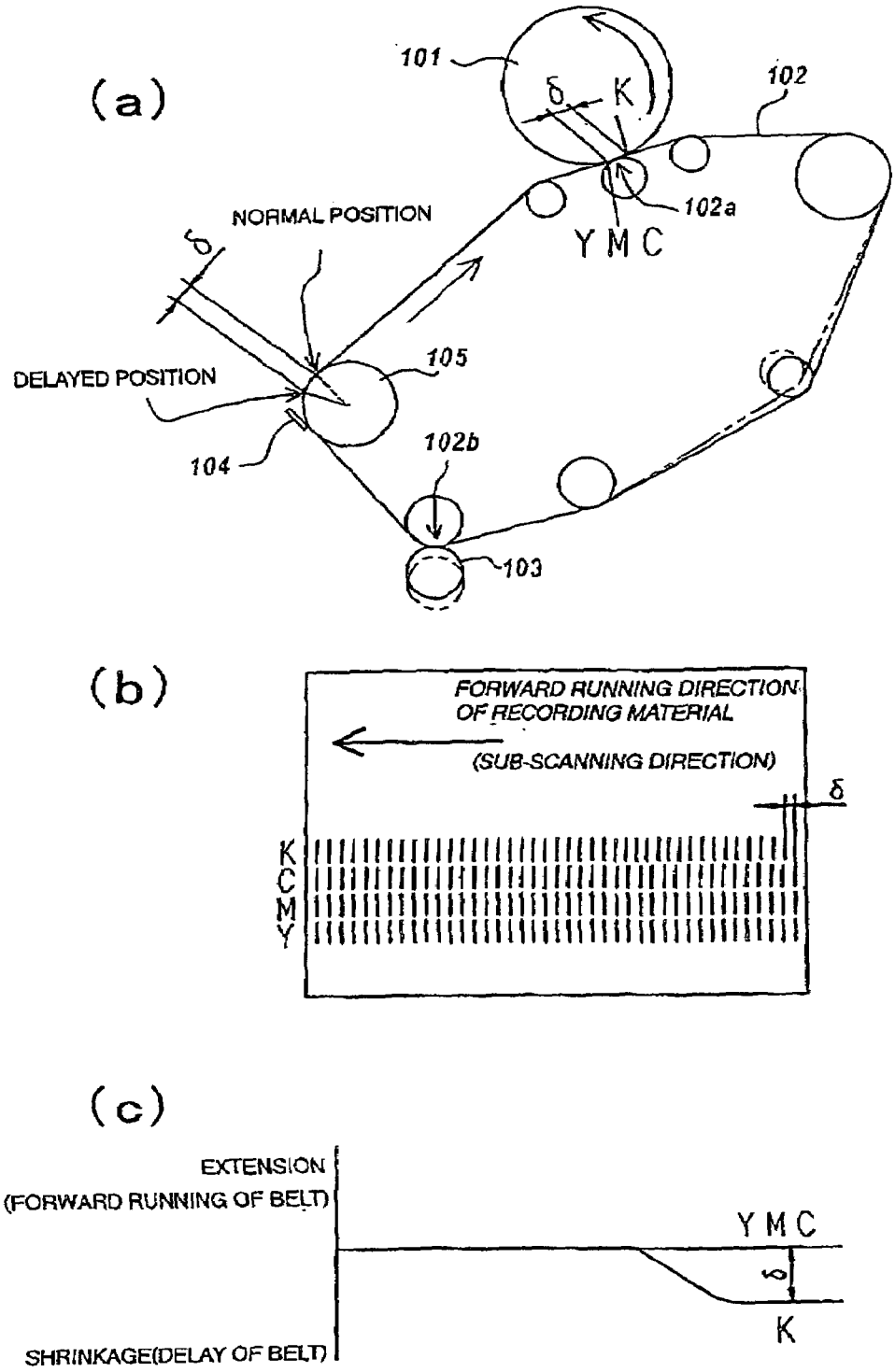
FIG. 7 are diagrams used for explaining a conventional image forming apparatus.

That is, when the distance L on the belt from the driving roller 13 to the primary transfer unit T1 is changed by δL by displacement of the moving roller 21 that is the distance changing means, if it is assumed that the driving roller 13 is not displaced in the circumferential direction, the YMC images which have already been carried by the transfer belt are deviated in position by the distance δL. Therefore, if the deviation amount δ of the distance on the belt is set equal to a deviation amount δ generated by the load variation, they can be offset. With this, as shown in FIG. 2(*b*), the positional deviation between the K image which is the fourth color carried on the photosensitive member drum 1 by the primary transfer unit T1 and the YMC images which have already been carried on the intermediate transfer belt 7 is eliminated (see FIG. 7(*a*)).

FIGS. 3 show the color deviation of the image in the sub-scanning direction (transferring direction of the recording material). The horizontal axis shows position in the sub-scanning direction, and the vertical axis shows the color deviation amount of black that is the fourth color based on cyan that is the third color as a reference. The line LN1 shown in FIG. 3(*a*) shows the color deviation generated when the belt delays due to the load variation. If the transfer cleaner 12 abuts, black is deviated in the shrinking direction. The line LN2 shown in FIG. 3(*b*) shows the color deviation caused by the effect of only the distance changing means. If the moving roller 21 moves from the outward position toward the inward position, black is deviated in the extending direction. The line LN3 shown in FIG. 3(*c*) shows the actual color deviation in which both the effect of the load variation and the distance changing means are acting. By setting both the deviations equal to each other, the color deviation can be eliminated as illustrated.

In this manner, one of the plurality of rollers which support the intermediate transfer belt 7 is moved to change the distance on the belt, thereby preventing the color deviation. Therefore, variation in exposure of light (banding) generated by vibration transmitted to the photosensitive member drum 1 is prevented. As a method for offsetting the deviation of the belt, according to the conventional technique, the entire intermediate transfer unit is moved. Whereas, according to the present invention, only the supporting roller is moved. If the intermediate transfer unit having large mass is moved, there is a fear that large vibration is generated. According to the present invention, only the supporting roller having much smaller mass as compared with the unit is moved, large vibration is not generated. With this, variation in exposure of light (banding) generated by vibration transmitted to the optical system or the photosensitive member drum is prevented.

In the above explanation, the response delay is not generated in the primary transfer unit T1 using the deviation between the deviation of the belt of the driving roller 13 in the circumferential direction (displacement of the driving roller in the circumferential direction) and the distance changed by moving the moving roller 21. In an actual case, however, the deviation of the primary transfer unit T1 with respect to the deviation of the transfer cleaner or the moving roller generates the response delay, and a member where it is required to eliminate the deviation is the primary transfer unit T1. Next, a color deviation preventing method when the response delay is generated between the deviation of the transfer cleaner or the moving roller and the deviation of the belt in the primary transfer unit and they do not coincide on the time axis will be explained.

FIG. 4(*a*) shows variation with time of the deviation amount of the intermediate transfer belt 7 caused when the transfer cleaner 12 approaches and separates. The line LN4 shows a drive profile of the transfer cleaner 12, the line LN5 shows a time axis waveform of the belt deviation in the transfer cleaner, the line LN6 shows a time axis waveform of the belt in the primary transfer unit T1. As shown in the drawing, the deviation of the belt in the transfer cleaner immediately react with the approaching and separating motions of the transfer cleaner 12, but the deviation of the belt in the primary transfer unit T1 does not coincide with this, and response delay is generated. It is conceived that such a response delay is generated, in some cases, due to the disposition of rollers in the unit, the tension of the belt and the holding force of the drum and the belt in the primary transfer unit.

FIG. 4(*b*) shows variation with time of the deviation amount generated when the moving roller 21 moves. The line LN7 shows a drive profile of the moving roller 21, the line LN8 shows the time axis waveform of the belt deviation in the moving roller, and the line LN9 shows the time axis waveform of the belt deviation in the primary transfer unit. The response delay is generated in the belt deviation in the primary transfer unit T1 with respect to the belt deviation in the moving roller. However, since the moving roller is closer to the primary transfer unit T1 than the transfer cleaner, the response delay is smaller.

FIG. 4(*c*) shows an example in which the deviation amount of the belt caused when the transfer cleaner in the primary transfer unit approaches and separates, and the deviation amount of the belt caused when the moving roller moves are added to each other. Even if the timing and the moving amount are set such that the deviation amount LN8 of the belt by the moving roller 21 and the deviation amount LN5 of the belt in the transfer cleaner coincide with each other and are offset, since there is a difference in the response delay degree, the deviation amounts LN9 and LN6 in the primary transfer unit T1 are not symmetric. Thus, temporarily belt deviation is generated as shown by the line LN10 that is the superimposed waveform of both of them, and the color deviation is generated. To solve this problem, the drive profile of the moving roller 21 should be changed.

Here, the drive profile is a definition to control the approaching and separating motions of the transfer cleaner 12 and the movement of the moving roller 21 (driving of the moving means (not shown)). More specifically, this is a definition to limit the moving amount of the moving roller 21 as an example of the distance changing means with respect to time based on the timing at which the transfer cleaner 12 as an example of load applying means changes a load (timing at which the transfer cleaner 12 is allowed to abut) as a reference. In accordance with this drive profile, control means (not shown) of the image forming apparatus controls the driving of the moving means of the moving roller 21, and the moving roller 21 is allowed to carry out desired movement.

FIG. 5(*a*) shows the time axis waveform of the color deviation when the drive profile of the moving roller 21 is changed. The line LN11 shows the drive profile of the moving roller 21, the line LN12 shows the time axis waveform of the belt deviation in the moving roller, and the line LN13 shows the time axis waveform of the belt deviation in the primary transfer unit. By changing the drive profile of the moving roller 21 in this manner, the time axis waveform of the belt deviation in the primary transfer unit T1 can be changed. In this example, as compared with the drive profile shown in FIG. 4(*b*), the drive profile is changed from a rectangular shape to a trapezoidal shape, and the moving roller 21 is gently moved. With this, the time axis waveform LN13 of the belt deviation in the primary transfer unit also becomes gentler than the LN9 shown in FIG. 4(*b*). This corresponds to a fact that the response delay in the moving roller is smaller than that in the transfer cleaner.

FIG. 5(*b*) shows an example in which the deviation amount of the belt when the drive profile of the moving roller 21 is changed is added. The LN14 shows the actual color deviation in which the belt deviation LN6 in the primary transfer unit T1 caused when the transfer cleaner 12 approaches and separates and the belt deviation LN13 caused when the moving roller 21 moves are superimposed on each other. By changing the setting of the drive profile of the moving roller 21 in this manner, the belt deviation LN6 and the belt deviation LN13 can coincide with each other (symmetric), and it is possible to largely reduce the color deviation over the entire region of the time axis as shown in the drawing.

Examples of a realizing method of the drive profile of the moving roller 21, there are a method in which independent driving means such as a stepping motor is provided as the moving means to perform sequential control, a method in which the profile is limited by driving a cam, and a method in which delay is mechanically set using a damper and a spring in association with the driving means which allows the transfer cleaner 12 to approach and separate.

The transfer cleaner 12 is separated after the rear end of the toner image region S passes. At that time, since load applied to the intermediate transfer belt 7 from the transfer cleaner 12 is eliminated, reverse deviation amount δ is generated by the load variation. At that time, the driving roller 13 returns in the moving direction, the belt runs fast, and the Y image that is the first color of a next image is extended. Even in such a case, if the moving roller 21 is moved from the inward position (position B in the drawing) to the outward position (position A in the drawing) in accordance with the distance of the transfer cleaner 12 with the same structure and the drive profile as those described above, the distance L (length of path) on the belt from the driving roller 13 to the primary transfer unit T1 is increased. With this, the belt deviations can coincide with each other and offset each other, and the color deviation can remarkably be reduced.

This embodiment showed a solving method of a case having response delay characteristics in which the belt deviation caused when the transfer cleaner 12 approaches and separates and the belt deviation caused when the moving roller 21 moves are different from each other. If both the response delay characteristics are the same, since the drive profiles of the separation of the transfer cleaner 12 and the movement of the moving roller 21 may be the same, the moving means of the moving roller 21 may be associated with the driving means which allows the transfer cleaner 12 to approach and separate.

Although the moving roller 21 is provided downstream from the driving roller 13 in the above explanation, the present invention is not limited to this. For example, even if the positions of the moving roller 21 and the tension roller 16 are interchanged, it is possible to eliminate the color deviation by operating the moving roller 21 such that belt deviation generated by the load variation and deviation in the opposite direction are generated.

Although the transfer cleaner 12 and the driving roller are opposed to each other in the above explanation, the present invention is not limited to this. For example, when the driving roller is provided downstream from the primary transfer unit and a roller opposed to the transfer cleaner 12 is formed as an idler roller, it is also possible to eliminate the color deviation by providing the moving roller 21 between the primary transfer unit and the driving roller and by generating the belt deviation generated by the load variation and a deviation in the opposite direction.

Although the transfer cleaner 12 is explained as the example of the load applying means in the above explanation, the present invention is not limited to this. It is possible to eliminate the color deviation by providing the secondary transfer roller 9 as the load applying means also and by operating the moving roller such that the belt deviation caused by this and a deviation in the opposite direction are generated. In this case, a plurality of moving rollers as the example of the distance changing means may be provided in accordance with the number of load applying means.

Although the moving roller 21 moves in the direction substantially perpendicular to the intermediate transfer belt in the above explanation, the invention is not limited to this only if the moving roller 21 moves on a locus in which the path of the intermediate transfer belt can be changed. For example, the locus may be inclined along the intermediate transfer belt at a predetermined angle (e.g., about 15°). With this structure, the driving force for moving the moving roller can be reduced. Further, since the change of the path length of the intermediate transfer belt with respect to the moving distance of the moving roller is reduced, it becomes easy to control the drive profile.

Although the moving roller 21 is provided as the example of the distance changing means in the above explanation, the invention is not limited to this only if the distance changing means changes the distance on the intermediate transfer belt between the driving means and the primary transfer unit, and the distance changing means may change the position of the driving means for example. However, it is difficult to displace the driving roller as the example of the driving means in terms of precision.

In this embodiment, when the distances between the driving roller 13 to the auxiliary roller 18 are 100 mm, if the operation amount of the moving roller 21 is set to 2.2 mm, the deviation amount of the belt in the circumferential direction becomes 100 μm. When the operation amount of the moving roller 21 is deviated from a predetermined amount (2.2 mm) by 0.1 mm, the deviation amount of the belt in the circumferential direction is deviated by 10 μm. An error is as small as 10% (high precision).

In the structure in which the driving roller 13 is displaced in parallel to the belt, a desired deviation amount of the belt in the circumferential direction and the deviation amount of the driving roller 13 must be equal to each other. That is, when the deviation amount of the belt in the color deviation should be 100 μm, the operation amount of the driving roller 13 must be 0.1 mm, and if the deviation amount is 0.1 mm, an error becomes as large as 100%.

In the method in which the driving roller 13 is displaced in a direction perpendicular to the belt, a large error is generated due to the moving angular deviation. If the driving roller deviation amount is 4.5 mm in an apparatus in which the distances between the driving roller 13 to the auxiliary roller 18 are 100 mm, a belt deviation amount of 100 μm in the circumferential direction can be obtained, but if the moving angle of the driving roller is deviated by 1°, an error of 80 μm is generated. The error is as large as 80%. If the driving roller deviation amount is as large as 4.5 mm, the driving and inputting structure becomes difficult. To secure the relative position with respect to the transfer cleaner 12, if the transfer cleaner 12 is also displaced together, the displacing mechanisms of the driving roller 13 and the transfer cleaner 12 become large in size and thus, this is not preferable.

According to the structure of this embodiment, sufficient distances are provided between the driving roller 13 to the auxiliary roller 18, the operation amount of the moving roller 21 can be increased with respect to the deviation amount of the belt in the color deviation. As a result, even if precision of operation amount of the moving roller is low, there is an effect that the deviation amount of the belt in the circumferential direction can be controlled precisely.

The present invention can be utilized in an image forming apparatus having one photosensitive member drum and intermediate transfer belt.

CROSS-REFERENCE TO RELATED APPLICATION

This application claims the benefit of priority from the prior Japanese Patent Application No. 2004-231408 filed on Aug. 6, 2004 the entire contents of which are incorporated herein by reference.

What is claimed is:

1. An image forming apparatus comprising:

an image bearing member;

toner image forming means for forming toner images on the image bearing member;

a rotatable intermediate transfer belt on which the toner image is primarily transferred;

a driving roller configured and positioned to rotate the intermediate transfer belt by rotating itself and contacting the intermediate transfer belt in a driving region;

a driving source positioned to apply a driving force to the driving roller;

primary transfer means for primary transferring the toner images on the image bearing member to the intermediate transfer belt in a primary transfer region when the intermediate transfer belt is rotating for superimposing the toner images on the image bearing member on the intermediate transfer belt;

secondary transfer means for secondary transferring the toner images on the intermediate transfer belt to a recording material;

removing means for removing toner on the intermediate transfer belt by abutting the intermediate transfer belt, which can abut against and separate from the intermediate transfer belt; and a movable member configured and positioned to move and to contact the intermediate transfer belt at a position downstream of the driving region in the rotating direction of the intermediate belt and upstream of the primary transfer region in the rotating direction, which shortens the length of a moving locus of the intermediate transfer belt from the driving region to the primary transfer region according to the change in the position of the removing means from a separating position at which the removing means is separated from the intermediate transfer belt to an abutting position at which the removing means abuts against the intermediate transfer belt.

2. The image forming apparatus according to claim 1, further comprising a tension roller biased by a spring and contacting the intermediate transfer belt to apply a force thereto.

3. An image forming apparatus comprising:

an image bearing member;

toner image forming means for forming a toner image on the image bearing member;

a rotatable intermediate transfer belt on which the toner image is primarily transferred;

a driving roller configured and positioned to rotate the intermediate transfer belt by rotating itself and contacting the intermediate transfer belt in a driving region;

a driving source positioned to apply a driving force to the driving roller;

primary transfer means for primary transferring the toner image on the image bearing member to the intermediate transfer belt in a primary transfer region, when the intermediate transfer belt is rotating, for superimposing the toner image on the image bearing member on the intermediate transfer belt;

secondary transfer means for secondary transferring the toner images on the intermediate transfer belt to a recording material, which can abut against and separate from the intermediate transfer belt;

removing means for removing toner on the intermediate transfer belt by abutting the intermediate transfer belt; and a movable member configured and positioned to move and to contact the intermediate transfer belt at a position downstream of the driving region in a rotating direction of the intermediate transfer belt and upstream of the primary transfer region in the rotating direction, which shortens the length of a moving locus of the intermediate transfer belt from the driving region to the primary transfer region according to a change in the position of the removing means from a separating position at which the removing means is separated from the intermediate transfer belt to an abutting position at which the removing means abuts the intermediate transfer belt.

4. The image forming apparatus according to claim 3, further comprising a tension roller biased by a spring and contacting the intermediate transfer belt to apply a force thereto.

* * * * *